US005582540A

United States Patent [19]

Su et al.

[11] Patent Number: 5,582,540

[45] Date of Patent: Dec. 10, 1996

[54] HYDROSTATIC AND HYDRODYNAMIC POLISHING TOOL

[75] Inventors: Yaw-Terng Su; Chuen-Chyi Horng, both of Kaohsiung; Jiunn-Ji Wu, Keelung; Jia-Yang Zhang, Tao-Yuan Hsien, all of Taiwan

[73] Assignee: National Science Council of R.O.C, Taipei, Taiwan

[21] Appl. No.: 589,194

[22] Filed: Jan. 22, 1996

[51] Int. Cl.[6] ..... B24B 1/00

[52] U.S. Cl. ..... 451/259; 451/446; 451/64; 451/60; 451/66; 451/550; 451/36

[58] Field of Search ..... 451/36, 259, 59, 451/60, 53, 446, 450, 550, 905, 66, 285–290, 165

[56] References Cited

U.S. PATENT DOCUMENTS

| | | | |
|---|---|---|---|
| 2,855,244 | 10/1958 | Camp | 451/446 |
| 3,902,128 | 4/1974 | Minear et al. | 451/64 |
| 4,490,948 | 1/1985 | Hanstein et al. | 451/446 |
| 5,341,602 | 8/1994 | Foley | 451/36 |

FOREIGN PATENT DOCUMENTS

| | | | |
|---|---|---|---|
| 405285826 | 11/1993 | Japan | 451/446 |

*Primary Examiner*—D. S. Meislin
*Assistant Examiner*—George Nguyen
*Attorney, Agent, or Firm*—Merchant, Gould, Smith, Edell, Welter & Schmidt, P.A.

[57] ABSTRACT

A polishing tool includes a tool body and a polishing member which is mounted rotatably on the tool body and which has a central hole unit formed through the polishing member. The working surface of the polishing member has a plurality radially extending slots which are spaced apart from each other in an angularly equidistant relation and which extend from the inner periphery of the working surface to the outer periphery of the working surface. A plurality of flat working surface sections are defined on the working surface of the polishing member by the slots. When a slurry consisting of a lubricating liquid and abrasive grains flows onto the working surface of the polishing member via the central hole unit and when the polishing member is rotated on the tool body, each of the abrasive grains moves across all of the slots and from the inner periphery of the working surface to the outer periphery of the working surface, by hydrodynamic effect, so as to polish positively and effectively the workpiece.

14 Claims, 5 Drawing Sheets

HYDROSTATIC AND HYDRODYNAMIC POLISHING TOOL

BACKGROUND OF THE INVENTION

This invention relates to a polishing tool, more particularly to a polishing tool onto which a slurry is supplied so that the abrasive grains in the slurry move between the working surface of the tool and the face of a workpiece to be polished.

In case of micromachining, to make a face of a workpiece become smooth and shining, a slurry consisting of a lubricating liquid and abrasive grains of a relatively small size is supplied between the face of the workpiece and the flat working surface of a polishing tool. The lubricating liquid of the slurry is distributed evenly over the working surface of the tool by hydrostatic effect. The abrasive grains, however, in the slurry move randomly on the working surface of the tool, thereby resulting in uneven and uncontrollable distribution of the abrasive grains. As a result, part of the face of the workpiece cannot be polished positively. There is a need to polish efficiently and positively the workpiece in order to achieve automation of the polishing process.

SUMMARY OF THE INVENTION

An object of this invention is to provide a highly efficient polishing tool which can distribute evenly the abrasive grains of the slurry on the working surface of the tool, by hydrostatic, hydrodynamic, or hybrid effect, so as to offer a positive micromachining to the entire face of the workpiece that is to be polished.

According to this invention, a polishing tool is adapted to polish a workpiece which is placed in front of the tool. The tool includes a tool body, a polishing member mounted rotatably on the tool body, and a driving unit capable of being activated so as to rotate the polishing member on the tool body. The tool body has a slurry passage unit which is formed therein and which is adapted to permit flow of a slurry therethrough that consists of a lubricating liquid and abrasive grains. The polishing member has an axially extending central hole unit which is formed therethrough and which is communicated fluidly with the slurry passage unit, and a front end surface formed with a plurality of radially extending slots which are angularly spaced apart from each other and which extend from the inner periphery of the front end surface to the outer periphery of the front end surface, so as to define on the front end surface a plurality of flat working surface sections which are of a number corresponding to that of the slots, in such a manner that each of the flat working surface sections is located between an adjacent pair of the slots. The slurry flows from the slurry passage unit of the tool body into the slots of the member via the central hole unit of the member. When the driving unit activates the member to rotate on the tool body and when the slurry is supplied into the slurry passage unit of the tool body, each of the abrasive grains moves from one of the slots onto one of the flat working surface sections and between the one of the flat working surface sections and the workpiece, and enters into another one of the slots, by virtue of hydrodynamic effect, with a result that the abrasive grains move from the inner periphery of the front end surface of the member to the outer periphery of the front end surface of the member. In this way, each of the abrasive grains passes over all of the flat working surface sections so as to polish positively the entire face of the workpiece which is to be machined.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
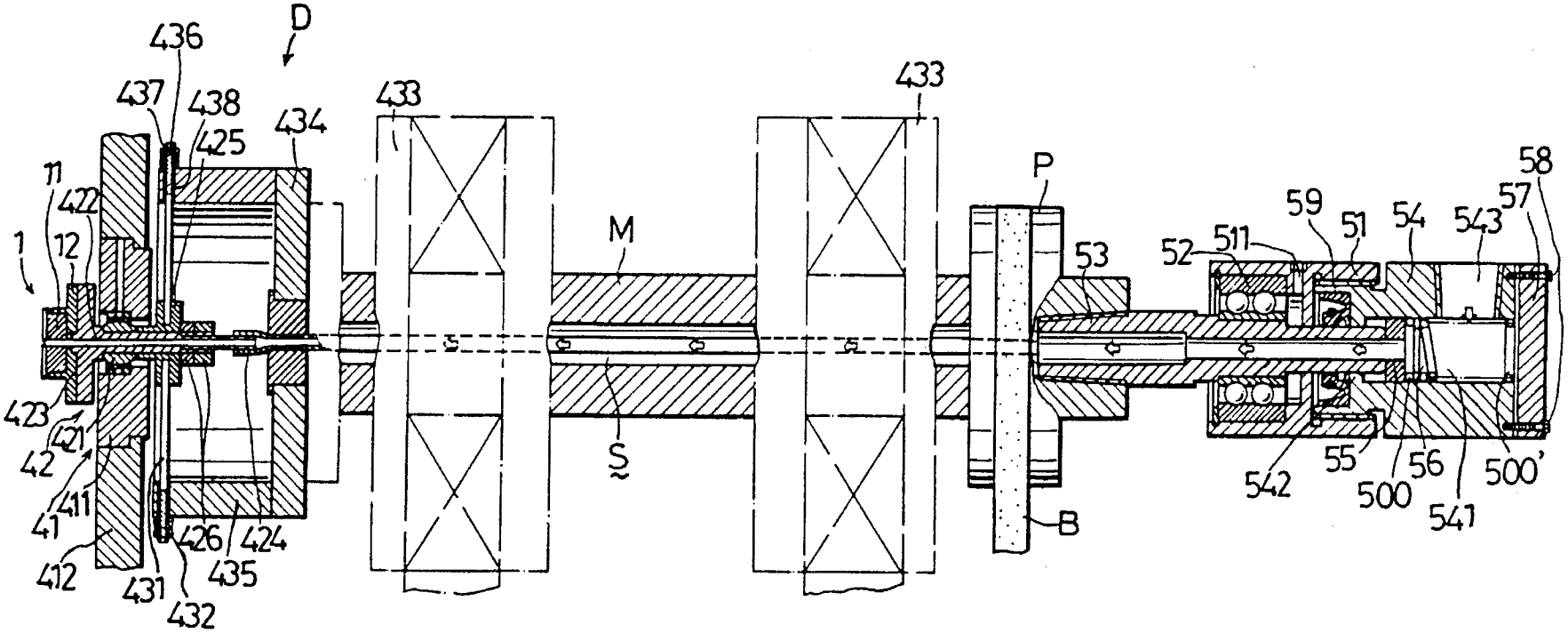
FIG. 1 illustrates a polishing tool according to this invention.
Figure 5:
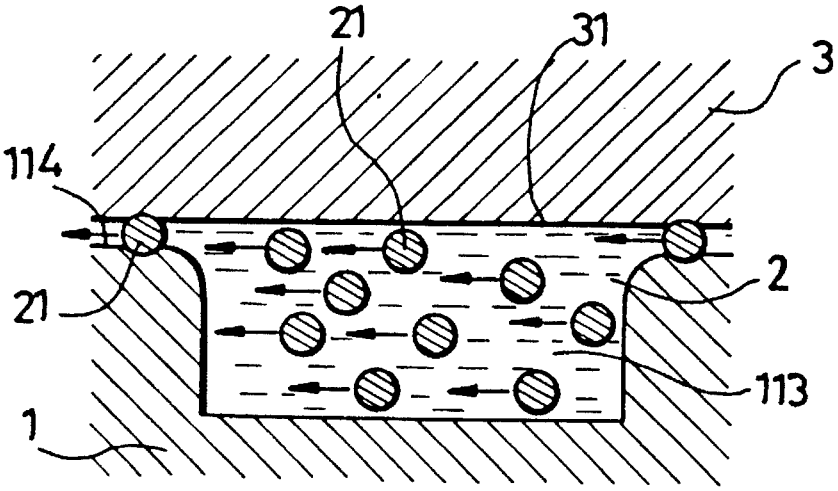
FIG. 5 illustrates movement of the abrasive grains of the slurry on the working surface of the polishing member of the polishing tool in accordance with this invention, by virtue of hydrodynamic effect, when the polishing member rotates on the tool body of the polishing tool.
Figure 6:
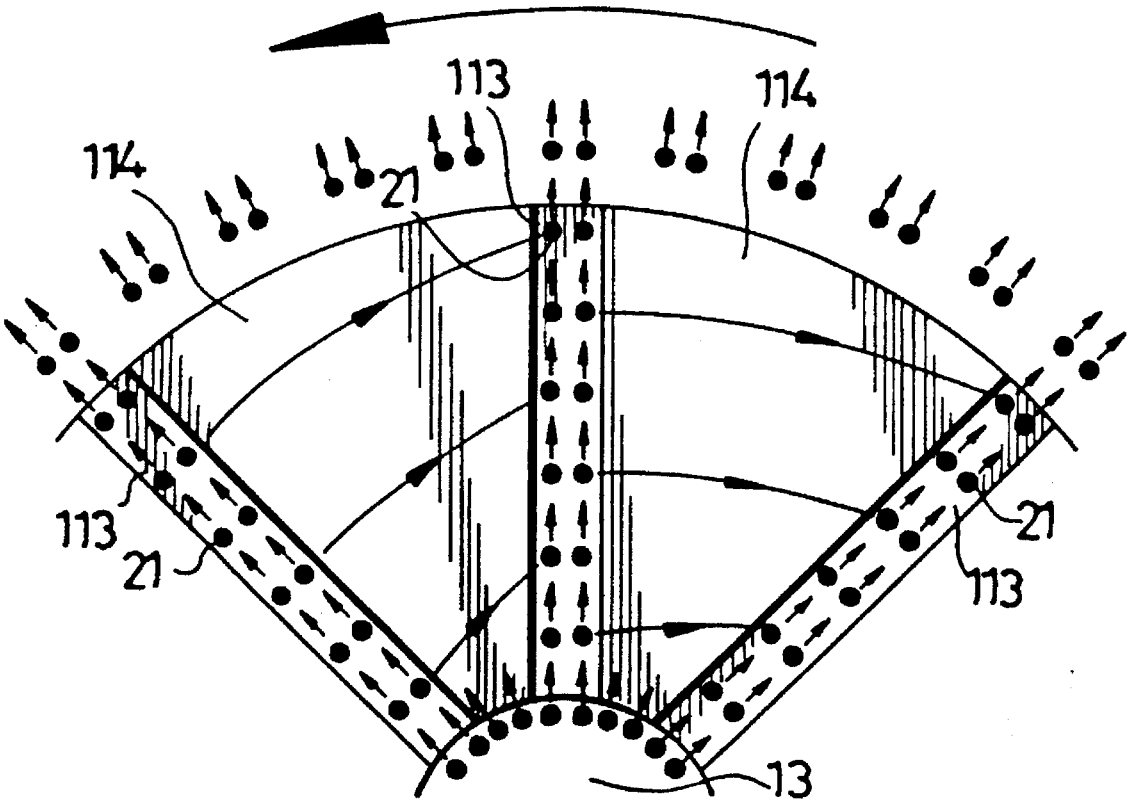
FIG. 6 illustrates movement of the abrasive grains of the slurry between the radially extending slots in the working surface of the polishing member of the polishing tool in accordance with this invention, when the polishing member rotates on the tool body.

Referring to FIG. 1, a polishing member of this invention includes a polishing member 1 which is mounted rotatably on the front end of a tool body and which is used to machine the flat face 31 (see FIG. 5) of a workpiece 3 (see FIG. 5) that is placed in front of the polishing member 1, in order to make the face 31 (see FIG. 5) of the workpiece 3 (see FIG. 5) become smooth and shining. The tool body has a slurry passage unit (S) (see FIG. 1) which is formed therein and which is adapted to permit flow of a slurry 2 (see FIG. 5) therethrough. As illustrated in FIG. 5, the slurry 2 consists of a lubricating liquid and abrasive grains 21.

Figure 2:
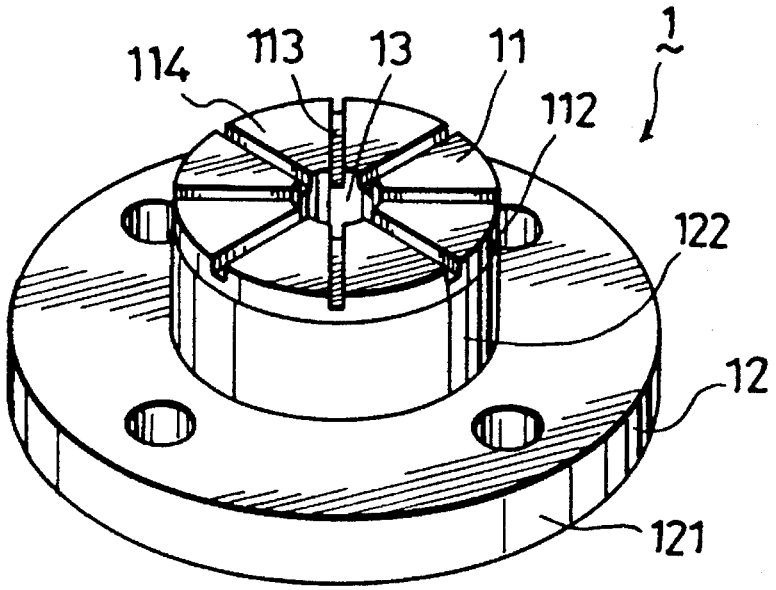
FIG. 2 is a perspective view showing the polishing member of the polishing tool according to this invention.
Figure 3:
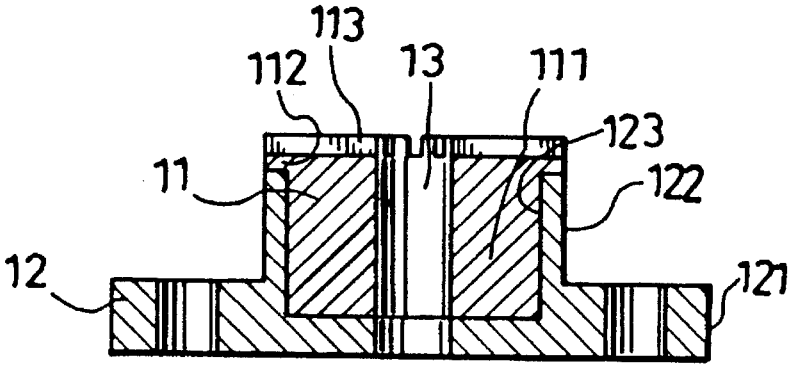
FIG. 3 is a sectional view showing the polishing member of the polishing tool according to this invention.

As shown in FIGS. 2 and 3, the polishing member 1 consists of a working element 11 and a mounting element 12 which are unitary pieces and which are made of rubber.

The mounting element 12 has a large-diameter rear portion 121 of a circular cross-section which is mounted rotatably on the tool body, and a small-diameter front portion 122 of a circular cross-section which has a diameter smaller than that of the large-diameter rear portion 121 and which has a front end surface formed with a circular recess 123.

The working element 11 has a small-diameter rear portion 111 of a circular cross-section press-fitted within the circular recess 123 of the mounting element 12, and a large-diameter front portion 112 of a circular cross-section which has a diameter larger than the small-diameter rear portion 111.

It is understood that, when the front end surface (i.e. the working surface) of the working element 11 is worn to an extent, the working element 11 can be easily removed from the mounting element 12 by hand for replacement.

The polishing member 1 has an axially extending central hole unit 13 formed therethrough and communicated fluidly with the slurry passage unit (S) (see FIG. 1), and eight radially extending slots 113 formed in the front end surface of the polishing member 1, which are spaced apart from each other in an angularly equidistant relationship and which extend from the inner periphery of the front end surface to the outer periphery of the front end surface, so as to define on the front end surface eight flat working surface sections 114, in such a manner that each of the flat working surface sections 114 is located between an adjacent pair of the slots 113. The slurry 2 flows from the slurry passage unit (S) (see FIG. 1) of the tool body into the slots 113 of the polishing member 1 via the central hole unit 13 of the polishing member 1.

Figure 4:
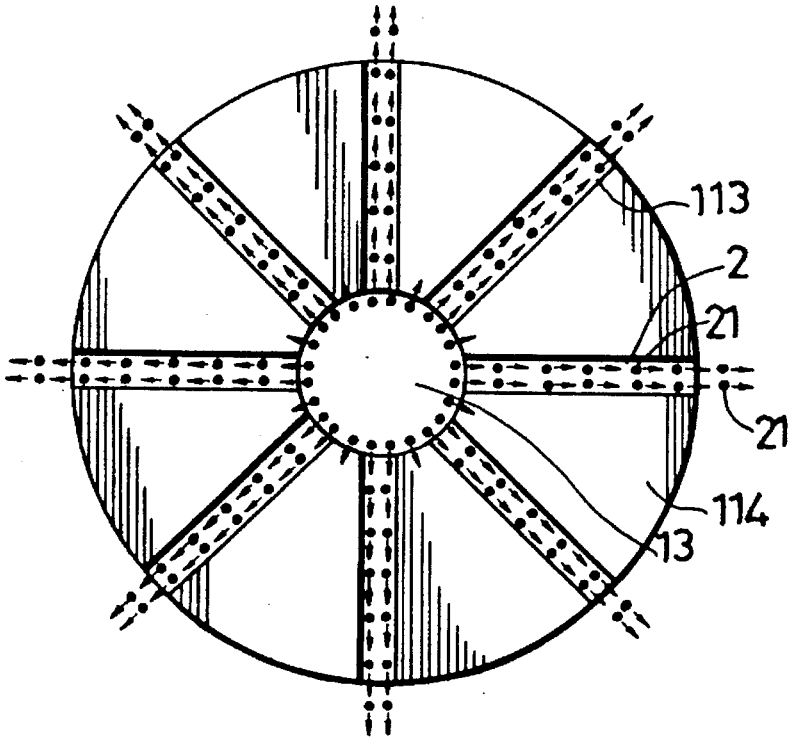
FIG. 4 illustrates movement of the abrasive grains of the slurry in the radially extending slots of the polishing member of the polishing tool in accordance with this invention, when the polishing member is idle.
Figure 7:
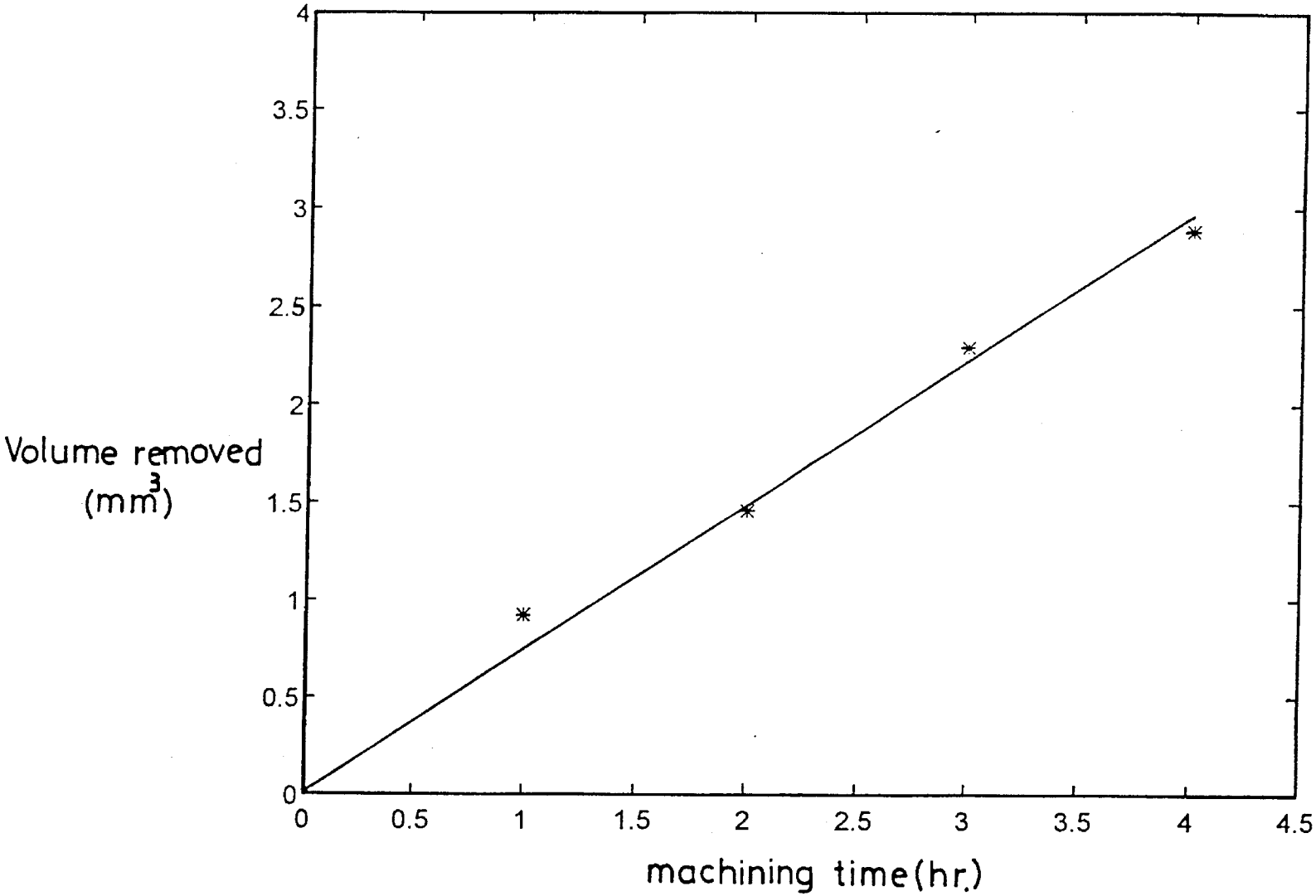
FIG. 7 is a diagram illustrating the relation between the volume of the workpiece removed and the time spent to polish the workpiece, during machining, in accordance with this invention.

A driving unit (D) (see FIG. 1) can be activated so as to rotate the polishing member 1 on the tool body of the tool. Referring to FIG. 3, when the slurry is supplied into the slurry passage unit (S) (see FIG. 1) of the tool body, the slurry fills the entire space defined between the face 31 (see FIG. 5) of the workpiece 3 (see FIG. 5) and the front end surface of the polishing member 1 by virtue of hydrostatic effect. Referring to FIGS. 4 and 5, when the driving unit (D) (see FIG. 1) activates the polishing member 1 to rotate on the tool body and when the slurry 2 is supplied into the slurry passage unit (S) (see FIG. 1) of the tool body, each of the abrasive grains 21 move from one of the slots 113 onto one of the flat working surface sections 114 and between the one of the flat working surface sections 114 and the face 31 of the workpiece 3 to be polished, and enters into another one of the slots 113, by virtue of hydrodynamic effect. Accordingly, each of the abrasive grains 21 moves across all of the slots 113. As a result, the abrasive grains 21 move from the inner periphery of the front end surface of the polishing member 1 to the outer periphery of the front end surface of the polishing member 1. In this way, the abrasive grains 21 can be distributed evenly over the whole face 31 of the workpiece 3, so as to effect an efficient polishing action, and in order to enable automation of the polishing process. As illustrated in the diagram of FIG. 7 which represents the relationship between the workpiece volume removed and the machining time, according to the result of a test effected by the applicants by use of a polishing tool of this invention, the workpiece volume removed is almost in direct proportion to the machining time. This is to say, the polishing tool of this invention is capable of polishing positively and effectively the workpiece. In three experiments tested by the applicants by use of three different polishing tools of this invention, the ratios of the workpiece depth removed to the machining time are 1.1 $\mu m^3$/1 hr, 1.8 $\mu m^3$/2 and 2.9 $\mu m^3$/3 hr and 3.7 $\mu m^3$/4 hr.

Again referring to FIG. 1, the tool body has a stationary structure 41 and a rotating device 42. The stationary structure 41 includes a bearing seat 411 and a support plate unit 412. The rotating device 42 includes a self-aligning bearing unit 421 installed on the bearing seat 411, and a hollow rotating shaft 422 journalled on the self-aligning bearing unit 421. The rotating shaft 422 is integrally formed with a mounting disk 423 on which the polishing member 1 is mounted securely and coaxially so as to effect automatic orientation adjustment of the polishing member 1, thereby bringing the front end surface of the polishing member 1 into parallel with the face 31 (see FIG. 5) of the workpiece 3 (see FIG. 5).

The rotating shaft 422 has an axially extending central bore formed therethrough which has a front end communicated fluidly with the central hole unit 13 of the polishing member 1. The slurry passage unit (S) includes a hose 424 having a front end that is sleeved fixedly on the rear end of the rotating shaft 422 and that is communicated fluidly with the central bore of the rotating shaft 422, so as to facilitate automatic orientation adjustment of the polishing member 1 when in use. A fastener device 425 is sleeved fixedly on the rotating shaft 422.

A balance device is coupled with the rotating shaft 422 so as to balance the rotating shaft 422 during rotation of the rotating shaft 422, and includes two internally threaded counterweights 426 which engage the externally threaded rear section of the rotating shaft 422.

The driving unit (D) includes several resilient strips 431, a tension adjustment device 432, two bearings 433, a rotary ring 434 and a driving arm 435. The strips 431 may be rubber strips which are fastened to a middle section of the rotating shaft 422 by means of the fastener device 425 and which respectively extend into the radially extending holes 438 of the driving arm 435. Alternatively, the strips 431 may be coiled tension springs. The tension adjustment device 432 consists of a plurality of bolts 436 respectively fastened to the outer ends of the strips 431 and having outer end portions respectively extending from the radially extending holes 438 of the driving arm 435, and a plurality of adjustment nuts 437 respectively and threadably engaging the bolts 436 and having inner ends which abut against the outer peripheral surface of the driving arm 435, so as to adjust magnitude of tension of the strips 431, thereby transferring effectively rotation of the driving arm 435 to the rotating shaft 422. The bearings 433 are disposed on a base (not shown) so as to journal a main shaft (M) thereon. The main shaft (M) has a front end connected securely to the rotary ring 434 so as to perform synchronous rotation thereof. A belt pulley (P) is installed on the main shaft (M) so that a motor (not shown) can drive the main shaft (M) by means of a belt (B) that interconnects the pulley (P) and the motor shaft of the motor. The rotary ring 434 is mounted rotatably on the tool body and has a central hole through which the hose 424 extends, so as to be rotated on the tool body. The driving arm 435 has a rear end portion secured to the ring 434, and a front end portion to which the outer ends of the strips 431 are fastened, in such a manner that the strips 431 interconnect the driving arm 435 and the rotating shaft 422 in a tautened condition.

The tool body further includes a bearing seat 51 fixed on the rear end section of the tool body, a bearing unit 52 installed on the bearing seat 51, a hollow driving shaft 53 journalled on the bearing unit 52 behind the self-aligning bearing 421, a generally cylindrical slurry acceptance member 54 having an externally threaded front end portion engaging threadably the internally threaded rear end portion of the bearing seat 51, a seal ring 55 coaxially received within the axially extending bore 541 of the slurry acceptance member 54, a bias device or coiled compression spring 56 biasing the seal ring 55 to contact the rear end of the driving shaft 53, and a cover 57 connected detachably to the rear end of the slurry acceptance member 54 by bolts 58 in such a manner that a liquid-tight seal is established therebetween.

The driving shaft 53 has a front end connected securely to the rear end of the main shaft (M) so as to rotate the driving shaft 53 synchronously with the main shaft (M), and is coupled with the hose 424 in such a manner that the axially extending central bore of the driving shaft 53 is communicated fluidly with the hose 424.

The slurry acceptance member 54 has a front end portion with an inwardly extending flange 542, and a radially extending bore 543 formed in an outer peripheral surface of the slurry acceptance member 54 and communicated fluidly with the axially extending bore 541 of the slurry acceptance member 54, so that the slurry can be supplied into the axially extending bore of the driving shaft 53 via the radially extending bore 543 of the slurry acceptance member 54 and via the axially extending bore 541 of the slurry acceptance member 54. During machining, the slurry is supplied continuously into the slurry acceptance member 54 so as to renew the abrasive grains 21 that move between the workpiece 3 (see FIG. 5) and the polishing member 1. As illustrated, the driving shaft 53 has a rear end which extends into the axially extending bore 541 of the slurry acceptance member 54 and which is located behind the flange 542.

The seal ring 55 has an outer periphery contacting a wall of the slurry acceptance member 54 which defines the axially extending bore 541 of the slurry acceptance member 54, and an inner peripheral portion contacting the rear end of the driving shaft 53.

The compression spring 56 is placed within the axially extending bore 541 of the slurry acceptance member 54 behind the seal ring 55 so as to press a front O ring 500 between the seal ring 55 and the slurry acceptance member 54, and so as to press a rear O ring 500' between the slurry acceptance member 54 and the cover 57, thus limiting the slurry to flow from the radially extending bore 543 of the slurry acceptance member 54 into the driving shaft 53 via the axially extending bore 541 of the slurry acceptance member 54.

The driving unit (D) further includes a liquid seal 59 placed in a space defined among the bearing seat 51, the driving shaft 53 and the slurry acceptance member 54 so as to establish a liquid-tight seal thereamong.

In case of leakage of the slurry from the axially extending bore 541 of the slurry acceptance member 54 onto the exterior surface of the driving shaft 53 and into the bearing seat 51, the leaked slurry can be seen from a counterbore 511 which is formed through a wall of the bearing seat 51.

With this invention thus explained, it is apparent that numerous modifications and variations can be made without departing from the scope and spirit of this invention. It is therefore intended that this invention be limited only as indicated in the appended claims.

We claim:

1. A polishing tool adapted to polish a workpiece which is placed in front of the tool, said tool comprising:

a tool body having a slurry passage unit which is formed therein and which is adapted to permit flow of a slurry therethrough that consists of a lubricating liquid and abrasive grains;

a polishing member mounted rotatably on said tool body and having an axially extending central hole unit formed through said member and communicated fluidly with said slurry passage unit, and a front end surface formed with a plurality of radially extending slots which are angularly spaced apart from each other and which extend from an inner periphery of said front end surface to an outer periphery of said front end surface, so as to define on said front end surface a plurality of flat working surface sections which are of a number corresponding to that of said slots, in such a manner that each of said flat working surface sections is located between an adjacent pair of said slots, said slurry flowing from said slurry passage unit of said tool body into said slots of said member via said central hole unit of said member; and a driving unit being capable of being activated so as to rotate said member on said tool body;

whereby, in use, when said driving unit activates said member to rotate on said tool body and when the slurry is supplied into said slurry passage unit of said tool body, each of said abrasive grains moves from one of said slots onto one of said flat working surface sections and between the one of said flat working surface sections and the workpiece, and enters into another one of said slots, by virtue of hydrodynamic effect, with a result that said abrasive grains move from the inner periphery of said front end surface of said member to the outer periphery of said front end surface of said member.

2. A polishing tool as claimed in claim 1, wherein said polishing member includes:

a unitary mounting element made of rubber and having a large-diameter rear portion of a circular cross-section which is mounted rotatably on said tool body, and a small-diameter front portion of a circular cross-section which has a diameter smaller than that of said large-diameter rear portion of said mounting element and which has a front end surface formed with a circular recess; and a unitary working element made of rubber and having a small-diameter rear portion of a circular cross-section press-fitted within said circular recess of said mounting element, and a large-diameter front portion of a circular cross-section which has a diameter larger than said small-diameter rear portion and which is formed with the front end surface;

whereby, when said front end surface is worn to an extent, said working element can be easily removed from said mounting element by hand for replacement.

3. A polishing tool as claimed in claim 1, wherein said tool body includes a self-aligning bearing unit installed thereon, and a rotating shaft journalled on said self-aligning bearing unit, said member being mounted securely and coaxially on said rotating shaft so as to effect automatic orientation adjustment of said member, thereby bringing said front end surface of said member into parallel with a face of the workpiece to be polished.

4. A polishing tool as claimed in claim 3, wherein said rotating shaft has an axially extending central bore formed therethrough which has a front end communicated fluidly with said central hole unit of said member, said slurry passage unit including a hose having a front end that is sleeved fixedly on a rear end of said shaft and that is communicated fluidly with said central bore of said rotating shaft, so as to facilitate automatic orientation adjustment of said member.

5. A polishing tool as claimed in claim 4, wherein said driving unit includes:

a rotary ring mounted rotatably on said tool body and having a central hole through which said hose extends, said ring being capable of being activated to rotate on said tool body;

a driving arm having a rear end portion secured to said ring, and a plurality of axially aligned resilient strips each of which has an inner end fastened to said rotating shaft and each of which extends radially and outwardly from said rotating shaft, and an outer end fastened to a front end portion of said driving arm, in such a manner that said strips interconnect said driving arm and said rotating shaft in a tautened condition.

6. A polishing tool as claimed in claim 5, wherein said resilient strips are coiled tension springs.

7. A polishing tool as claimed in claim 5, wherein said resilient strips are made of rubber.

8. A polishing tool as claimed in claim 5, wherein a tension adjustment device is coupled with said strips so as to adjust tension of said strips.

9. A polishing tool as claimed in claim 8, wherein said front end portion of said driving arm has an outer peripheral surface and a plurality of radially extending holes formed therethrough, said strips respectively extending into said radially extending holes of said driving arm, said tension adjustment device including:

a plurality of bolts respectively fastened to the outer ends of said strips, each of said bolts having an outer end portion extending from a corresponding one of said radially extending holes of said driving arm; and a plurality of adjustment nuts respectively and threadably engaging said bolts and having inner ends which abut against said outer peripheral surface of said driving arm, so as to adjust magnitude of tension of said strips, thereby transferring effectively rotation of said driving arm to said rotating shaft.

10. A polishing tool as claimed in claim 5, wherein a balance device is coupled with said rotating shaft so as to balance said rotating shaft during rotation of said rotating shaft.

11. A polishing tool as claimed in claim 10, wherein said resilient strips are attached to a middle section of said rotating shaft, said rotating shaft having an externally threaded rear section, said balance device including a plurality of internally threaded counterweights engaging threadably said threaded rear section of said rotating shaft.

12. A polishing tool as claimed in claim 5, wherein said driving unit includes:

a bearing seat fixed on said tool body;

a bearing unit installed on said bearing seat;

a hollow driving shaft journalled on said bearing unit behind said self-aligning bearing and having a rear end and a front end which is connected securely and coaxially to said rotary ring, said driving shaft being capable of being rotated on said tool body and including an axially extending central bore which is formed through said driving shaft, said driving shaft being coupled with said hose in such a manner that said axially extending central bore of said driving shaft is communicated fluidly with said hose;

a generally cylindrical slurry acceptance member attached to said bearing seat and having a front end portion with an inwardly extending flange, an axially extending bore formed through said slurry acceptance member, and a radially extending bore formed in an outer peripheral surface of said slurry acceptance member and communicated fluidly with said axially extending bore of said slurry acceptance member so that the slurry can be supplied into said axially extending bore of said driving shaft via said radially extending bore of said slurry acceptance member and via said axially extending bore of said slurry acceptance member, said driving shaft having a rear end which extends into said axially extending bore of said slurry acceptance member and which is located behind said flange;

a seal ring received coaxially within said axially extending bore of said slurry acceptance member and having an outer periphery contacting a wall of said slurry acceptance member which defines said axially extending bore of said slurry acceptance member, and an inner peripheral portion contacting the rear end of said driving shaft, in such a manner that a liquid-tight seal is established between said driving shaft and said slurry acceptance member;

a bias device biasing said seal ring to abut against the rear end of said driving shaft; and a cover connected detachably to a rear end of said slurry acceptance member in such a manner that a liquid-tight seal is established therebetween.

13. A polishing tool as claimed in claim 12, wherein said bias device is a coiled compression spring placed within said axially extending bore of said slurry acceptance member behind said seal ring so as to press said seal ring against the rear end of said driving shaft.

14. A polishing tool as claimed in claim 12, wherein said bearing seat has an internally threaded rear end portion, said slurry acceptance member having an externally threaded front end portion engaging threadably said internally threaded rear end portion of said bearing seat, in such a manner that a space is defined among said driving shaft, said bearing seat and said slurry acceptance member, said driving unit further including a liquid seal placed in the space so as to establish a liquid-tight seal among said driving shaft, said bearing seat and said slurry acceptance member.

* * * * *